US009502006B1

(12) United States Patent
Galloup

(10) Patent No.: US 9,502,006 B1
(45) Date of Patent: Nov. 22, 2016

(54) LOAD DISPLACEMENT ASSEMBLY AND A STRINGED MUSICAL INSTRUMENT INCLUDING THE SAME

(71) Applicant: Guitar Hospital, Inc., Big Rapids, MI (US)

(72) Inventor: Bryan John Galloup, Big Rapids, MI (US)

( * ) Notice: Subject to any disclaimer, the term of this patent is extended or adjusted under 35 U.S.C. 154(b) by 117 days.

(21) Appl. No.: 14/485,741

(22) Filed: Sep. 14, 2014

(51) Int. Cl.

| | |
|---|---|
| ***G10D 3/02*** | (2006.01) |
| ***G10D 1/08*** | (2006.01) |
| ***G10D 3/04*** | (2006.01) |
| ***G10D 3/12*** | (2006.01) |
| ***G10D 3/06*** | (2006.01) |

(52) U.S. Cl.
CPC *G10D 1/08* (2013.01); *G10D 3/02* (2013.01); *G10D 3/04* (2013.01); *G10D 3/06* (2013.01); *G10D 3/12* (2013.01)

(58) Field of Classification Search
USPC ..... 84/291
See application file for complete search history.

(56) References Cited

U.S. PATENT DOCUMENTS

| | | | | |
|---|---|---|---|---|
| 519,416 | A * | 5/1894 | Turner | G10D 3/04 84/299 |
| 3,656,395 | A * | 4/1972 | Kaman | G10D 3/02 84/267 |
| 4,549,460 | A | 10/1985 | Gressett, Jr. et al. | |
| 4,793,233 | A | 12/1988 | Olthoff | |
| 5,171,927 | A | 12/1992 | Kubicki et al. | |
| 5,355,759 | A | 10/1994 | Hoshino | |
| 5,661,252 | A | 8/1997 | Krawczak | |
| 5,889,221 | A | 3/1999 | Dejima | |
| 6,166,308 | A * | 12/2000 | Lam | G10D 3/02 84/290 |
| 6,271,457 | B1 * | 8/2001 | Hudak | G10H 3/185 84/731 |
| 7,166,788 | B2 * | 1/2007 | Wyman | G10D 3/02 84/291 |
| 8,076,559 | B2 | 12/2011 | Toone | |
| 8,203,059 | B2 * | 6/2012 | Miloslavsky | G10D 3/12 84/267 |
| 8,378,191 | B2 * | 2/2013 | Barillaro | G10D 3/02 84/267 |
| 2008/0190263 | A1 * | 8/2008 | Drew | G10D 3/02 84/291 |
| 2015/0243262 | A1 * | 8/2015 | Falbo | G10D 3/04 84/297 R |

* cited by examiner

*Primary Examiner* — Christopher Uhlir

(57) ABSTRACT

A load displacement assembly is disclosed herein. The load displacement assembly includes a saddle member, the saddle member configured to receive a load from one or more strings of a musical instrument; at least one upper load displacement component coupled to the saddle member in a load carrying manner, the at least one upper load displacement component configured to transfer the load from the saddle member to one or more connecting members; and a lower load displacement component coupled to the one or more connecting members in a load carrying manner, the lower load displacement component configured to transfer the load from the one or more connecting members to a monopole area of the soundboard of the musical instrument. A stringed musical instrument, which includes the load displacement assembly, is also disclosed herein.

18 Claims, 12 Drawing Sheets

LOAD DISPLACEMENT ASSEMBLY AND A STRINGED MUSICAL INSTRUMENT INCLUDING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a load displacement assembly. More particularly, the invention relates to a load displacement assembly that is utilized in a stringed musical instrument.

2. Background

A conventional stringed musical instrument has a load point that is determined by the fixed location of the bridge of the instrument. When the strings of the instrument vibrate, the vibrations travel through the saddle to the bridge, and then, from the bridge to the soundboard of the instrument. The vibrations cause the entire soundboard to oscillate. If the stringed musical instrument is an acoustic instrument, such as an acoustic guitar, the body of the instrument forms a hollow soundbox that amplifies the vibrations of the soundboard. The soundboard of the instrument is provided with a large aperture that allows the sounds to be transmitted from the hollow soundbox of the instrument.

However, because the load point on a conventional musical instrument is dictated by the location of the bridge, it is extremely difficult, and often impossible, to combine different scale lengths with a particular instrument format. For example, a musician may want to add a longer or shorter scale length to an instrument format that he or she is used to playing. Although, because the desired longer or shorter scale length is incongruent with the instrument format, a conventional musical instrument cannot support the desired longer or shorter scale length. In particular, with such a conventional musical instrument, the load point of the desired longer or shorter scale length does not function as needed for proper load bearing tone of the instrument. Thus, considering the design restrictions of conventional musical instruments, it is not possible to effectively combine different desired scale lengths with a particular instrument format.

Therefore, what is needed is a device that is capable of displacing a musical instrument's desired load point so as to match up with alternative, desired scale lengths, while maintaining the proper bearing point location for correct intonation. Moreover, a load displacement device is needed that enables different scale lengths and instrument formats to be readily combined with one another without compromising the proper load bearing tone of the instrument. Furthermore, there is a need for a load displacement device that can be easily adapted for use with virtually all stringed musical instrument formats.

BRIEF SUMMARY OF EMBODIMENTS OF THE INVENTION

Accordingly, the present invention is directed to a load displacement assembly and a stringed musical instrument including the same that substantially obviates one or more problems resulting from the limitations and deficiencies of the related art.

In accordance with one or more embodiments of the present invention, there is provided a load displacement assembly that includes a saddle member, the saddle member configured to receive a load from one or more strings of a musical instrument; at least one upper load displacement component, the at least one upper load displacement component configured to be disposed above a soundboard of a musical instrument, the at least one upper load displacement component being coupled to the saddle member in a load carrying manner, and the at least one upper load displacement component configured to transfer the load from the saddle member to one or more connecting members, the one or more connecting members configured to pass through the soundboard of the musical instrument; and a lower load displacement component, the lower load displacement component configured to be disposed beneath the soundboard of the musical instrument, the lower load displacement component being coupled to the one or more connecting members in a load carrying manner, the lower load displacement component configured to transfer the load from the one or more connecting members to a monopole area of the soundboard of the musical instrument.

In a further embodiment of the present invention, the at least one upper load displacement component comprises a combined bridge and tailpiece subassembly, the combined bridge and tailpiece subassembly configured to be mounted in a suspended position above the soundboard of the musical instrument.

In yet a further embodiment, the combined bridge and tailpiece subassembly includes a bridge and tailpiece body portion and a plate member, the plate member being removably coupled to the bridge and tailpiece body portion.

In still a further embodiment, the one or more connecting members comprise one or more threaded fastening devices configured to pass through the soundboard of the musical instrument.

In yet a further embodiment, the lower load displacement component comprises a central convex spine portion configured to enhance a stiffness of the lower load displacement component.

In still a further embodiment, the lower load displacement component comprises a body portion, the body portion of the lower load displacement component including concave notches formed in opposed sides thereof so as to minimize an overall weight of the lower load displacement component.

In yet a further embodiment, the lower load displacement component comprises a plurality of apertures disposed through the body portion thereof, a first set of the plurality of apertures being configured to receive the one or more connecting members, a second set of the plurality of apertures being configured to receive fasteners for coupling the lower load displacement component to a faux bridge of the musical instrument, the second set of the plurality of apertures being spaced apart from the first set of the plurality of apertures by a predetermined distance.

In accordance with one or more other embodiments of the present invention, there is provided a stringed musical instrument that includes a musical instrument body with a soundboard; a neck having a first end portion and a second end portion, the second end portion of the neck being coupled to the musical instrument body; a plurality of strings extending from the first end portion of the neck to the soundboard of the musical instrument body; a load displacement assembly coupled to the soundboard of the musical instrument body, the load displacement assembly including a load bearing component, each of the plurality of strings configured to apply a load to the load bearing component, the load displacement assembly configured to transfer the load applied to the load bearing component by each of the plurality of strings to a monopole area of the soundboard of the musical instrument.

In a further embodiment of the present invention, the load displacement assembly further comprises: at least one upper load displacement component, the at least one upper load displacement component disposed above the soundboard of the musical instrument body, the at least one upper load displacement component being coupled to the load bearing component in a load carrying manner, and the at least one upper load displacement component configured to transfer the load from the load bearing component to one or more connecting members, the one or more connecting members configured to pass through the soundboard of the musical instrument body; and a lower load displacement component, the lower load displacement component disposed beneath the soundboard of the musical instrument body, the lower load displacement component being coupled to the one or more connecting members in a load carrying manner, the lower load displacement component configured to transfer the load from the one or more connecting members to the monopole area of the soundboard of the musical instrument.

In yet a further embodiment, the at least one upper load displacement component comprises a combined bridge and tailpiece subassembly, the combined bridge and tailpiece subassembly configured to be mounted in a suspended position above the soundboard of the musical instrument.

In still a further embodiment, the combined bridge and tailpiece subassembly includes a bridge and tailpiece body portion and a plate member, the plate member being removably coupled to the bridge and tailpiece body portion.

In yet a further embodiment, the one or more connecting members comprise one or more threaded fastening devices configured to pass through the soundboard of the musical instrument.

In still a further embodiment, the lower load displacement component comprises a central convex spine portion configured to enhance a stiffness of the lower load displacement component.

In yet a further embodiment, the lower load displacement component comprises a body portion, the body portion of the lower load displacement component including concave notches formed in opposed sides thereof so as to minimize an overall weight of the lower load displacement component.

In still a further embodiment, the lower load displacement component comprises a plurality of apertures disposed through the body portion thereof, a first set of the plurality of apertures receiving the one or more connecting members, a second set of the plurality of apertures receiving fasteners for coupling the lower load displacement component to a faux bridge of the musical instrument, the second set of the plurality of apertures being spaced apart from the first set of the plurality of apertures by a predetermined distance.

In yet a further embodiment, the faux bridge is located within the monopole area of the soundboard of the musical instrument.

In still a further embodiment, the musical instrument body further includes one or more brace members disposed underneath the soundboard, the lower load displacement component being disposed beneath the one or more brace members.

In yet a further embodiment, the one or more brace members comprise a plurality of brace members disposed underneath the soundboard; and wherein the lower load displacement component comprises a first end and a second end, the second end of the lower load displacement component being disposed opposite to the first end, the one or more connecting members being coupled to the lower load displacement component proximate to the first end thereof, and the second end of the lower load displacement component being located proximate to an intersection location of the plurality of brace members.

In still a further embodiment, the load bearing component, is located outside of the monopole area of the soundboard of the musical instrument.

In accordance with yet one or more other embodiments of the present invention, there is provided a stringed musical instrument that includes a musical instrument body with a soundboard; a neck having a first end portion and a second end portion, the second end portion of the neck being coupled to the musical instrument body; a plurality of strings extending from the first end portion of the neck to the soundboard of the musical instrument body; a load displacement assembly coupled to the soundboard of the musical instrument body, the load displacement assembly including a load bearing component and a plurality of load displacement components coupled to one another in load carrying succession, each of the plurality of strings configured to apply a load to the load bearing component, the load bearing component configured to transfer the applied load to a first of the plurality of load displacement components in the load carrying succession, and a last of the plurality of load displacement components in the load carrying succession configured to transfer the load to a monopole area of the soundboard of the musical instrument.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Figure 1:
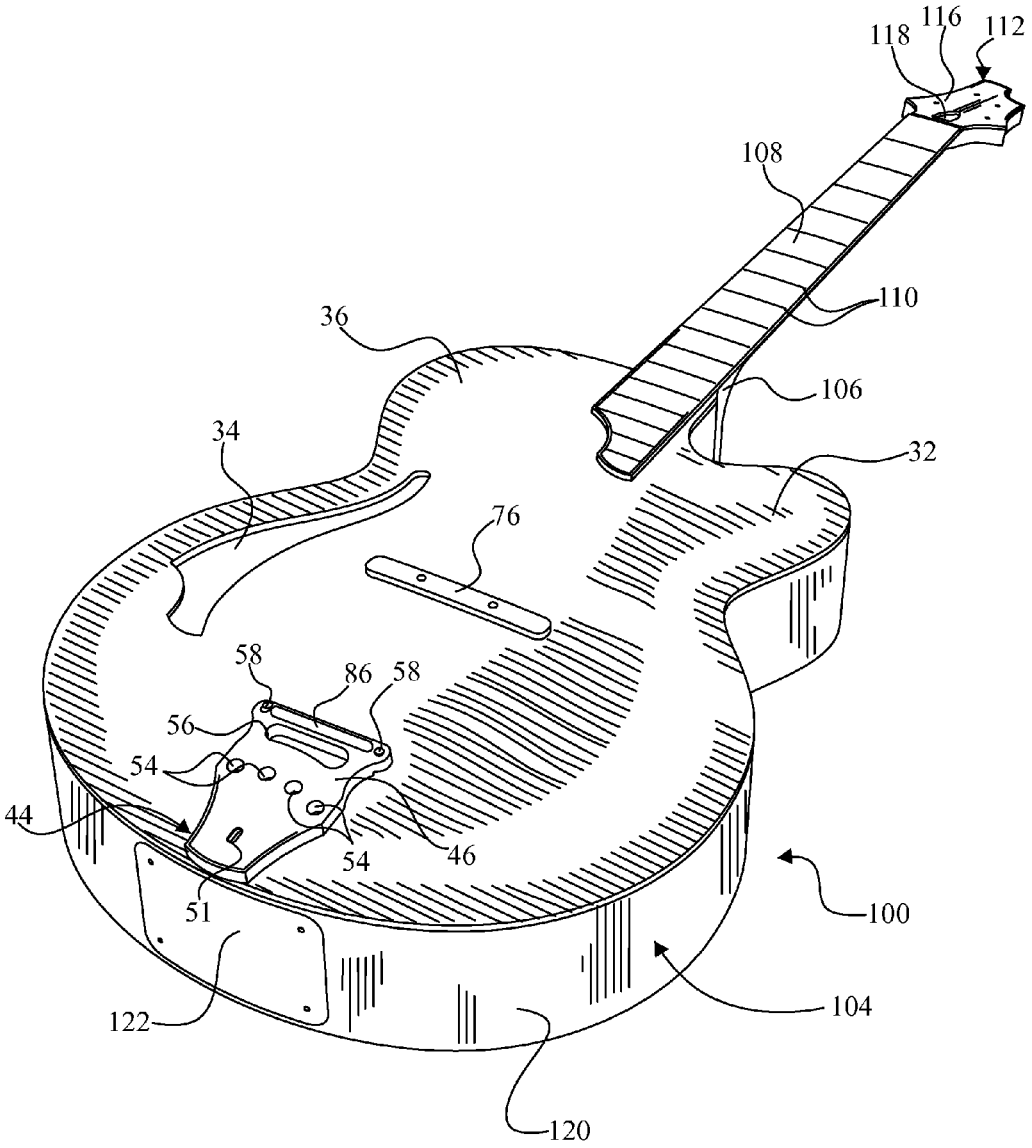
FIG. 1 is an overall perspective view of a stringed musical instrument with a load displacement assembly, according to an embodiment of the invention, wherein the strings of the stringed musical instrument have been removed to better illustrate the other features of the stringed musical instrument.

Throughout the figures, the same parts are always denoted using the same reference characters so that, as a general rule, they will only be described once. Also, all references to direction and position, unless otherwise indicated, refer to the orientation of the stringed musical instrument illustrated in the drawings. In general, up or upward refers to an upward direction extending out of the plane of the paper in FIG. 2 and down or downward refers to a downward direction extending into the plane of the paper in FIG. 2.

DETAILED DESCRIPTION OF EMBODIMENT(S) OF THE INVENTION

Figure 2:
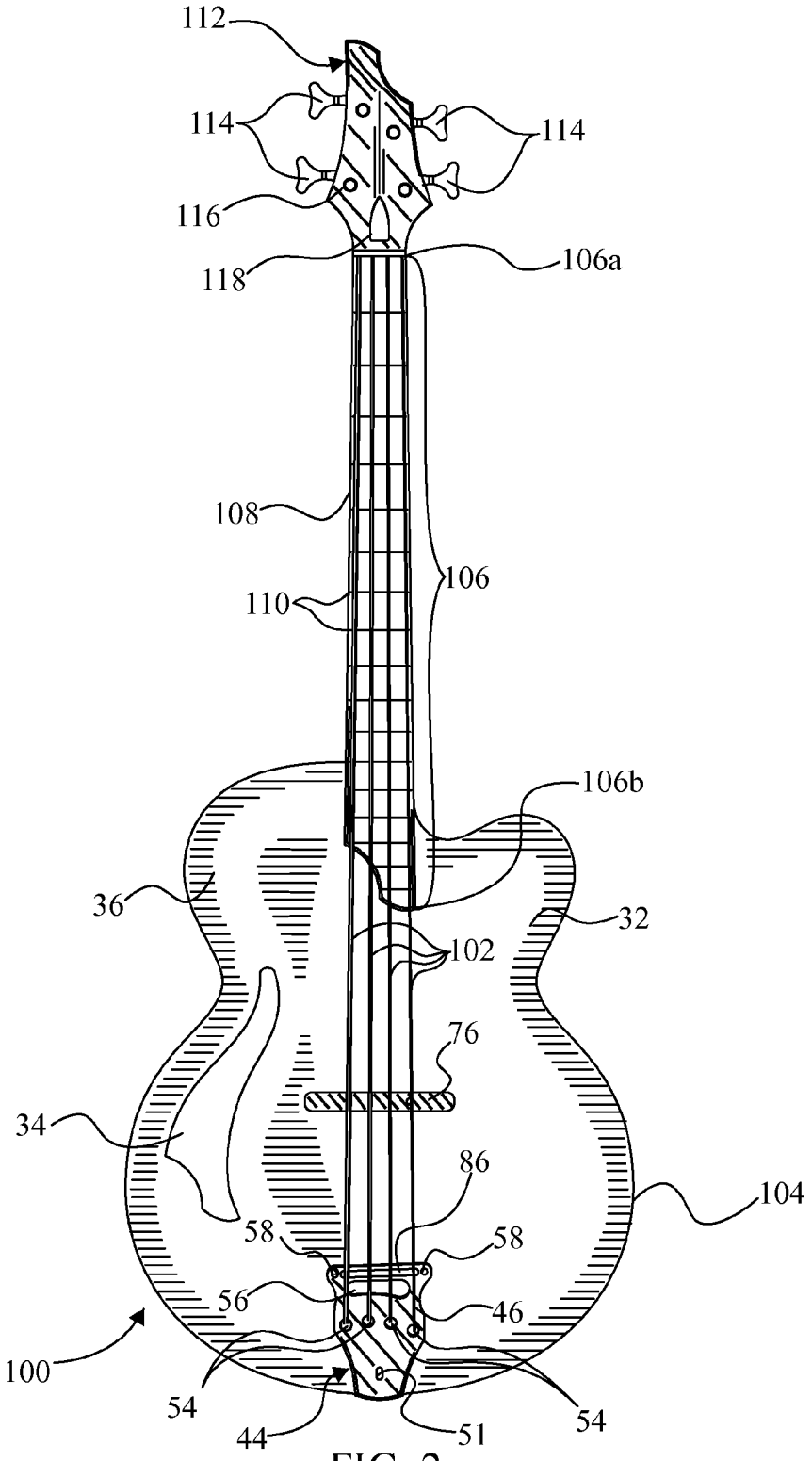
FIG. 2 is a top view of the stringed musical instrument of FIG. 1, wherein the strings of the stringed musical instrument are shown thereon.
Figure 3:
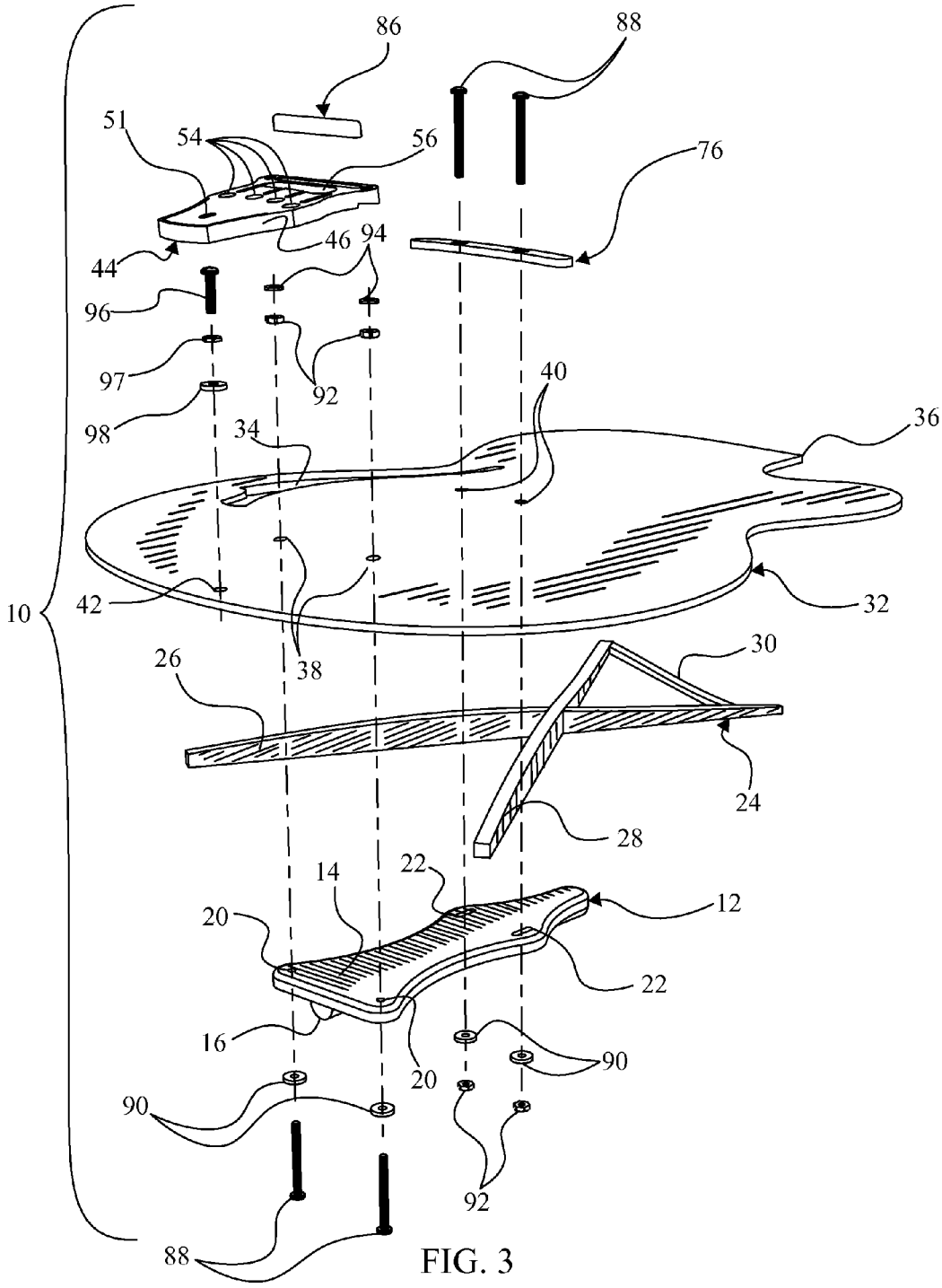
FIG. 3 is an exploded, partial perspective of a body portion of the stringed musical instrument of FIG. 1, wherein the constituent components of the load displacement assembly are shown exploded from the soundboard of the instrument body portion.
Figure 4:
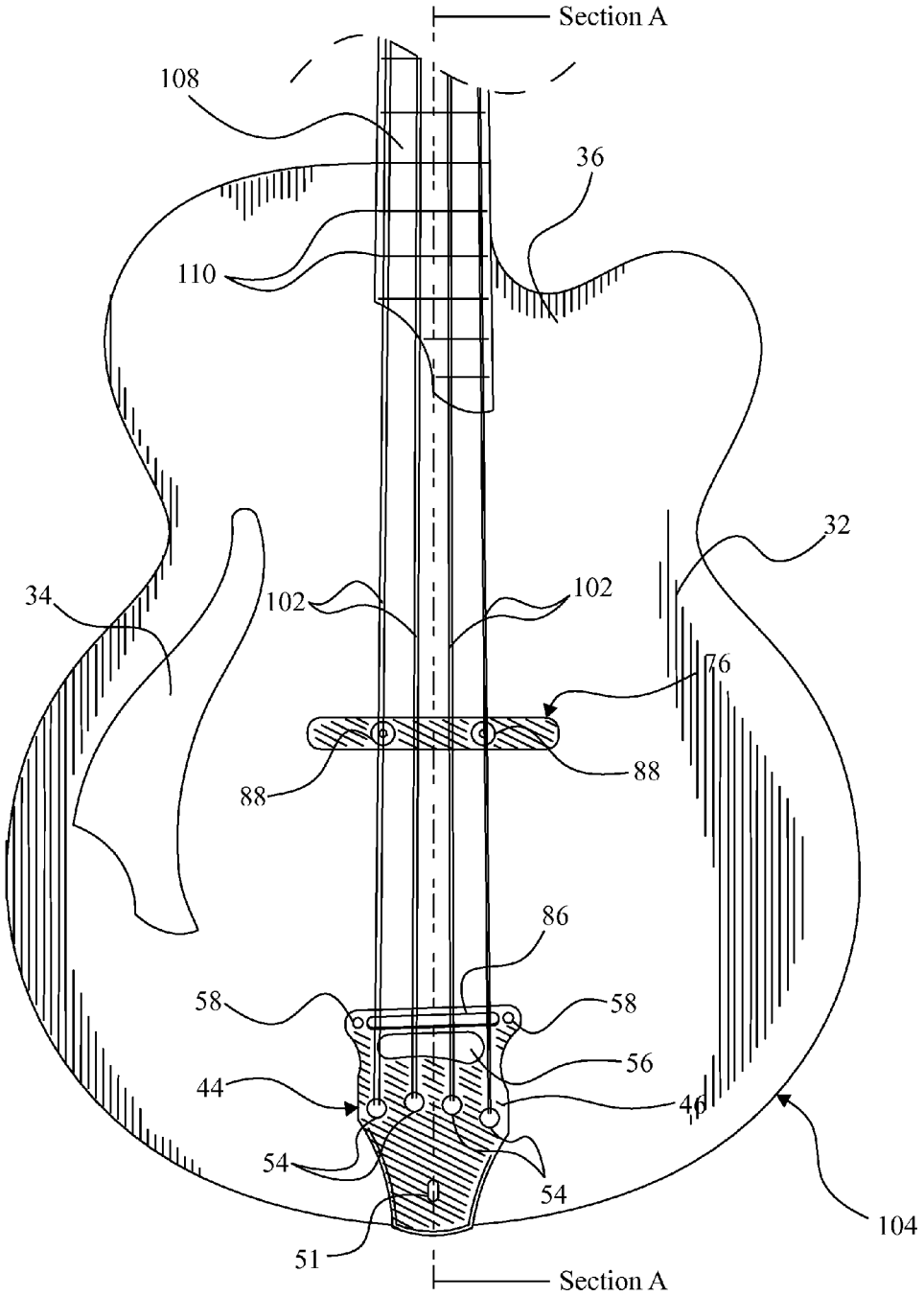
FIG. 4 is an enlarged top view of the body portion of the stringed musical instrument illustrated in FIG. 2.
Figure 6:
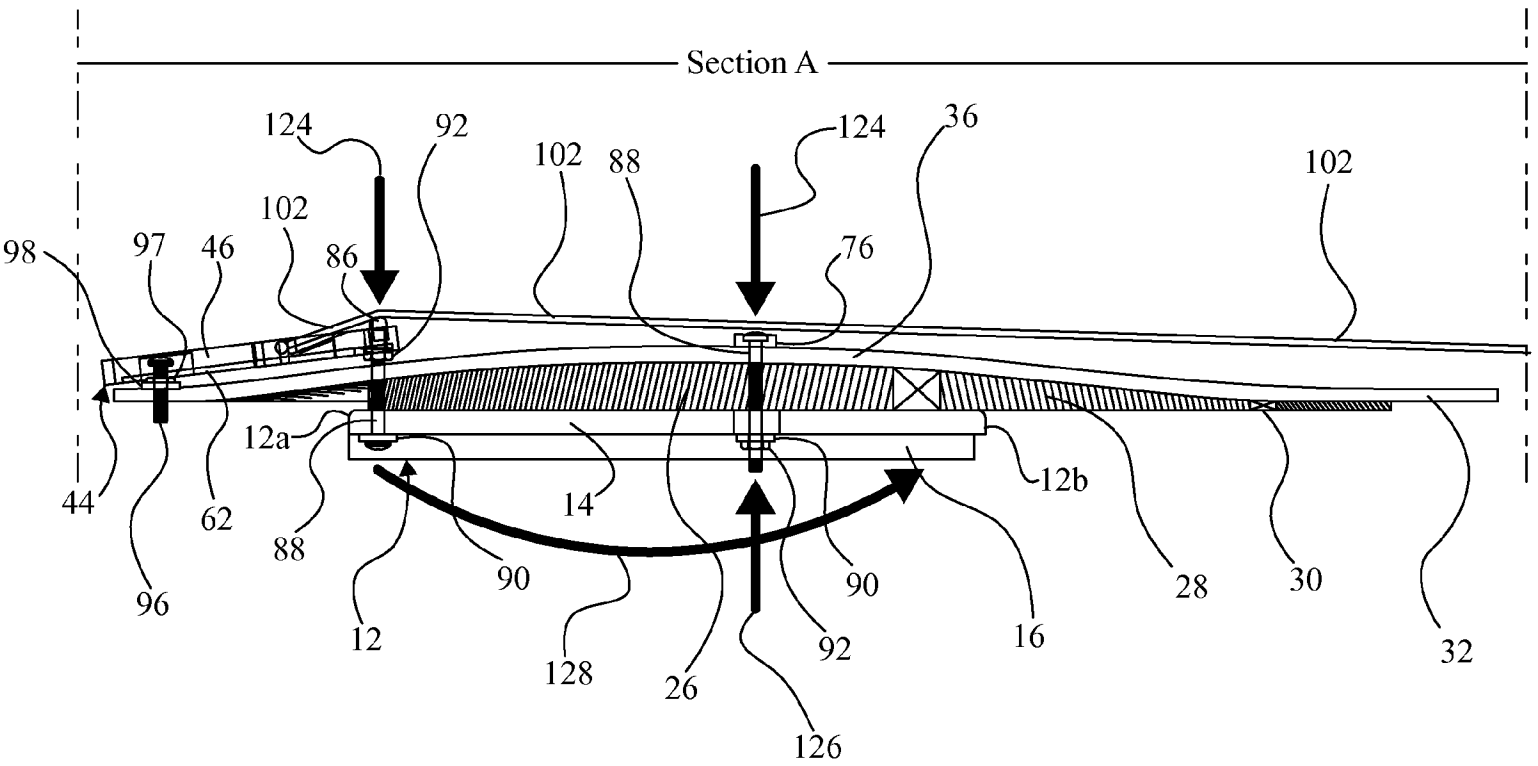
FIG. 6 is a partial sectional view of the soundboard and load displacement assembly of the stringed musical instrument of FIG. 1, which is cut along the cutting-plane line A-A in FIG. 4.

An illustrative embodiment of a stringed musical instrument with a load displacement assembly is seen generally at 100 in FIGS. 1 and 2. As illustrated in these figures, the stringed musical instrument 100 generally comprises a musical instrument body 104 with a soundboard 32; a neck 106 having a first end portion 106*a* and a second end portion 106*b*, the second end portion 106*b* of the neck 106 being coupled to the musical instrument body 104; a plurality of strings 102 extending from the first end portion 106*a* of the neck 106 to the soundboard 32 of the musical instrument body 104; and a load displacement assembly 10 (e.g., FIG. 3) coupled to the soundboard 32 of the musical instrument body 104. Referring to FIGS. 3, 4, and 6, it can be seen that the load displacement assembly 10 generally includes a load bearing component (i.e., a saddle member 86) and a plurality of load displacement components (e.g., 12, 44, 88) coupled to one another in load carrying succession. Each of the plurality of strings 102 is configured to apply a load to the load bearing component (e.g., a saddle member 86). In turn, the load bearing component (e.g., a saddle member 86) is configured to transfer the applied load to a first of the plurality of load displacement components in the load carrying succession (e.g., bridge and tailpiece combination body portion 46), and a last of the plurality of load displacement components (e.g., lower load displacement component 12) in the load carrying succession configured to transfer the load to a monopole area of the soundboard 32 (i.e., the central soundboard area proximate to the faux bridge 76) of the stringed musical instrument 100. In the illustrated embodiment, because the load bearing component (e.g., a saddle member 86) is located outside of the monopole area of the soundboard 32 of the musical instrument 100, the load displacement assembly 10 is advantageously used to transfer the load point of the instrument 100, which is disposed in a non-musical area, to a musical area (i.e., monopole area) of the soundboard 32 of the instrument 100.

Referring to FIGS. 1, 2, and 4, it can be seen that the neck 106 of the stringed musical instrument 100 comprises a fretboard 108 with a plurality of frets 110 spaced apart along the length thereof. In their relaxed state, the strings 102 of the musical instrument 100 are disposed slightly above the upper surface of the fretboard 108. A headstock 112 is located at the first end portion 106*a* of the neck 106. The headstock 112 comprises an overlay 116 disposed on the top surface thereof. Also, as shown in FIG. 2, the headstock 112 comprises a plurality of tuning pegs 114 (i.e., four (4) tuning pegs 114) that enable the tension of the strings 102 to be adjusted, which in turn, alters the pitch of the strings 102. In FIG. 2, it can be seen that one end of each string 102 of the musical instrument 100 is fixedly attached to the body 104 at a bridge and tailpiece combination subassembly 44, while the other, opposite end of each string 102 is adjustably attached to a respective tuning peg 114 of the headstock 112. In addition, as depicted in FIGS. 1 and 2, the headstock 112 comprises a truss rod access aperture 118 for accessing the truss rod disposed in the neck 106 of the instrument 100, when required for servicing or adjustment.

In FIG. 1, it can be seen that the instrument body 104 comprises a continuous curved sidewall 120 that is disposed at the outer periphery of the soundboard 32. In the illustrated embodiment, the continuous curved sidewall 120 of the instrument body 104 comprises a removable access panel 122 for gaining access to the component(s) of the load displacement assembly 10 that are disposed inside the instrument body 104 for servicing and/or adjustment (e.g., for gaining access to the lower load displacement component 12). In an exemplary embodiment, the removable access panel 122 may be removably coupled to the curved sidewall 120 of the instrument body 104 by a plurality of removable fasteners (e.g., four (4) screws). The soundboard 32 of the instrument body 104 is provided with an arched top 36 and a sound port 34 disposed therethrough for allowing the sounds that are amplified by the hollow body 104 to be discharged from interior of the body 104 to the ambient environment (i.e., so that the musical sounds generated by the instrument 100 can be heard by the musician and his or her audience).

Referring again to FIGS. 3, 4, and 6, it can be seen that the illustrated embodiment of the load displacement assembly generally includes the saddle member 86, the saddle member 86 being configured to receive a load from the strings 102 of the stringed musical instrument 100; at least one upper load displacement component (e.g., bridge and tailpiece combination subassembly 44), the at least one upper load displacement component 44 configured to be disposed above the soundboard 32 of the musical instrument 100, the at least one upper load displacement component 44 being coupled to the saddle member 86 in a load carrying manner, and the at least one upper load displacement component 44 configured to transfer the load from the saddle member 86 to one or more connecting members (e.g., fastener members 88), the one or more connecting members 88 configured to pass through the soundboard 32 of the stringed musical instrument 100; and a lower load displacement component 12, the lower load displacement component 12 configured to be disposed beneath the soundboard 32 of the stringed musical instrument 100, the lower load displacement component 12 being coupled to the one or more connecting members 88 in a load carrying manner, the lower load displacement component 12 configured to transfer the load from the one or more connecting members 88 to a monopole area of the soundboard 32 (i.e., the soundboard area proximate to the faux bridge 76) of the stringed musical instrument 100.

As mentioned above, in the illustrated embodiment, the at least one upper load displacement component comprises a combined bridge and tailpiece subassembly 44. As best shown in the sectional view of FIG. 6, the combined bridge and tailpiece subassembly 44 is mounted in a suspended position above the soundboard 32 of the musical instrument 100 by means of the fastener members 88, 92, 96. In FIG. 6, it can be seen that the combined bridge and tailpiece subassembly 44 is supported in a quasi-cantilevered manner above the soundboard 32, and is capable of slightly pivoting about a pivot end thereof proximate to the outer edge of the soundboard 32 when a load is applied thereto. In particular, the pivot end of the combined bridge and tailpiece subassembly 44, which is furthest from the saddle member 86, is mounted to the soundboard 32 by means of a threaded fastener (i.e., bolt 96). The shaft of the bolt 96 passes through a circular aperture 42 disposed in the soundboard 32 (see FIG. 3). In FIG. 6, it can be seen that the head of the bolt 96 is received within a cavity of the combined bridge and tailpiece subassembly 44. A nut 97 and a washer 98 are provided on the shaft of the bolt 96 between the bottom surface of the combined bridge and tailpiece subassembly 44 and the top surface of the soundboard 32. Referring to FIGS. 3 and 6, it can be seen that the washer 98 is disposed on the top surface of the soundboard 32, while the nut 97 is sandwiched the bottom surface of the combined bridge and tailpiece subassembly 44 and the top surface of the washer 98. The internal threads of the nut 97 threadingly engage the external threads on the bolt 96. The end of the combined bridge and tailpiece subassembly 44, which is opposite to the pivot end and closest to the saddle member 86, is mounted to the soundboard 32 and the lower load displacement component 12 by means of a plurality of threaded fasteners (i.e., two bolts 88). The shafts of the bolts 88 pass through respective circular apertures 38 disposed in the soundboard 32 (see FIG. 3). In particular, referring to FIGS. 3 and 6, it can be seen that the respective heads of the bolts 88 are disposed beneath the bottom surface of the lower load displacement component 12. A respective washer 90 is sandwiched between the respective head of each bolt 88 and the bottom surface of the lower load displacement component 12. A respective nut 92 and lock washer 94 are provided on the shaft of each bolt 88, proximate to the distal end of the bolt shaft. The internal threads of each respective nut 92 threadingly engage the external threads on each respective bolt 88. In FIG. 6, it can be seen that the respective nut 92 of each bolt 88 is provided between the bottom surface of the combined bridge and tailpiece subassembly 44 and the top surface of the soundboard 32. As such, the end of the combined bridge and tailpiece subassembly 44, which is closest to the saddle member 86, rests on the respective nuts 92 such that it generally "floats" above the top surface of the soundboard 32.

Now, referring to FIGS. 7-13, the structural features of the bridge and tailpiece combination subassembly 44 of the load displacement assembly 10 will be described in detail. As best shown in the exploded view of FIG. 13, the combined bridge and tailpiece subassembly 44 generally includes a bridge and tailpiece body portion 46 and a grounding plate member 62. The grounding plate member 62 is removably coupled to the bridge and tailpiece body portion 46 by a plurality of fasteners (i.e., screws 70). As such, the grounding plate member 62 can be disassembled from the combined bridge and tailpiece subassembly 44 by removing the screws 70.

Figure 7:
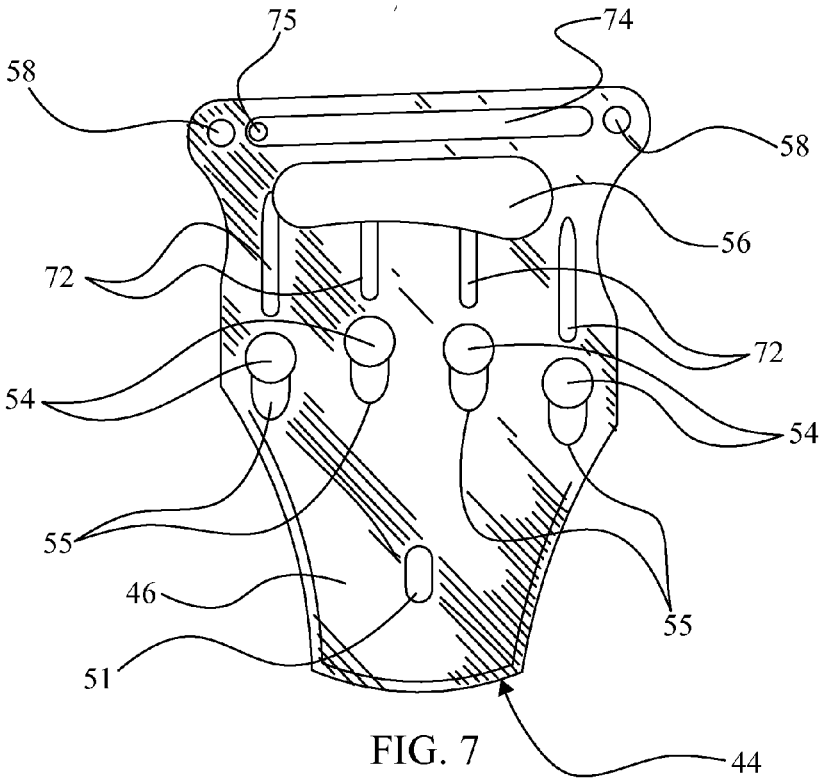
FIG. 7 is a top view of the bridge and tailpiece combination subassembly of the stringed musical instrument of FIG. 1.
Figure 8:
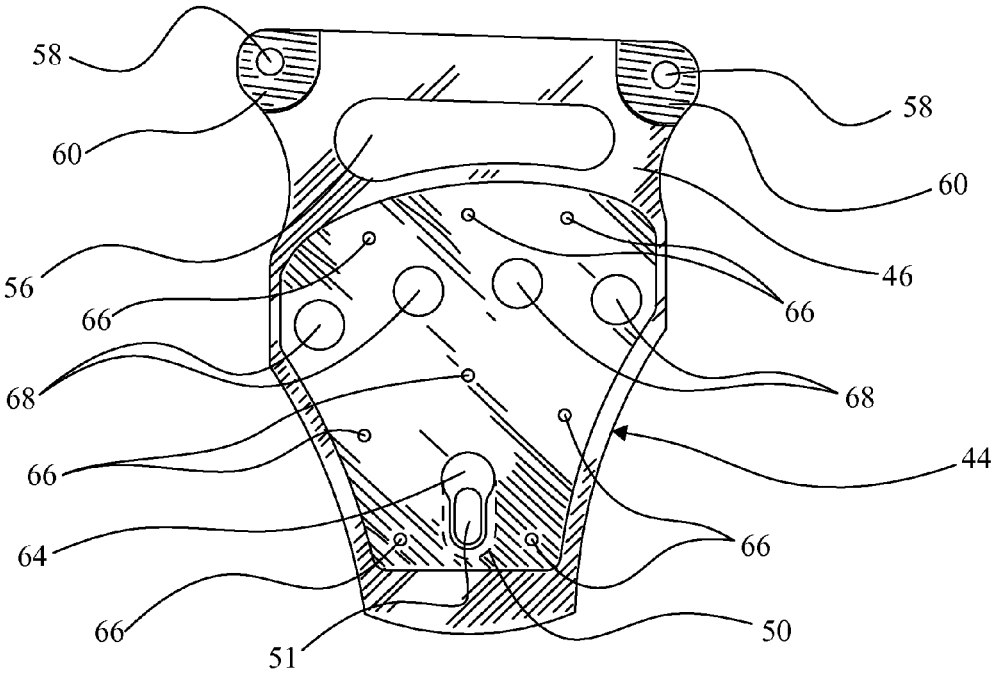
FIG. 8 is a bottom view of the bridge and tailpiece combination subassembly of the stringed musical instrument of FIG. 1.
Figure 9:
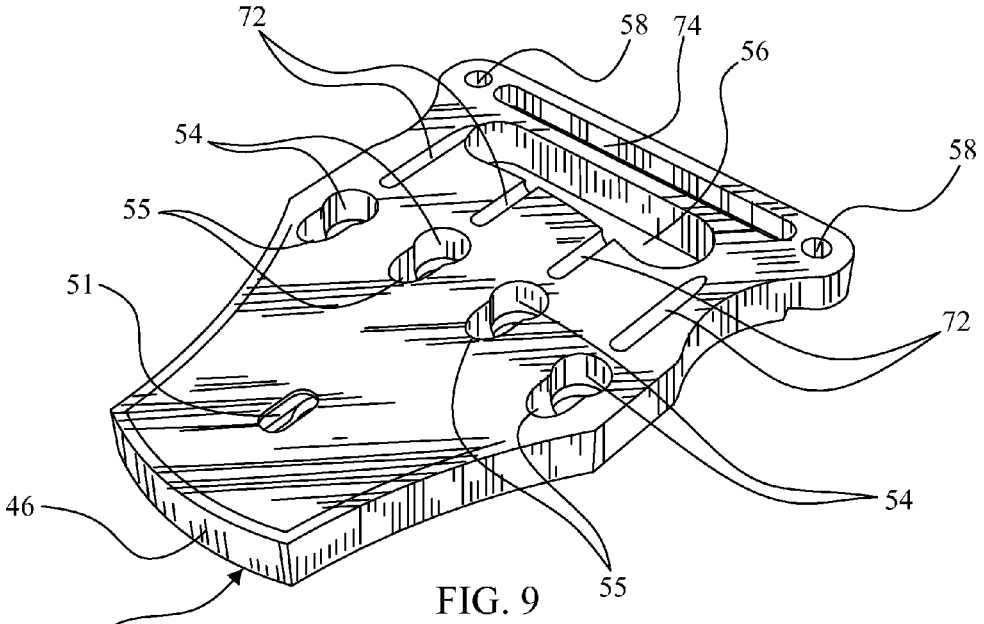
FIG. 9 is a top-side perspective view of the bridge and tailpiece combination subassembly of the stringed musical instrument of FIG. 1.

The features of the bridge and tailpiece body portion 46 are best shown in FIGS. 7-10 and 13. Referring initially to FIGS. 7 and 9, it can be seen that the bridge and tailpiece body portion 46 is provided with a plurality of string apertures 54 (i.e., four (4) apertures 54) disposed therethrough for accommodating the respective strings 102. Also, as best shown in the perspective view of FIG. 9, a circumscribing wall of each aperture 54 is provided with a notched portion 55 that extends towards the tail portion of bridge and tailpiece body portion 46 for accommodating guitar string ferrules (e.g., ferrule ball portions of the strings). The top surface of the bridge and tailpiece body portion 46 further comprises a plurality of elongate string grooves 72 that are substantially aligned with each of the respective strings 102. In FIGS. 7 and 9, it can be seen that the bridge portion of the bridge and tailpiece body portion 46 comprises an elongate groove 74 disposed transversely thereacross to accommodate the recessed mounting of the saddle member 86. That is, the lower portion of the saddle member 86 is fitted into the elongate groove 74. On oppositely disposed ends of the elongate groove 74, the bridge portion of the bridge and tailpiece body portion 46 is provided with circular fastener apertures 58 for receiving the respective connecting bolts 88 of the load displacement assembly 10. In addition, the bridge portion of the bridge and tailpiece body portion 46 is provided with an elongate aperture 56 disposed between the elongate string grooves 72 and the elongate groove 74 to reduce the weight of the bridge and tailpiece body portion 46 (i.e., to decrease the overall weight of the stringed musical instrument 100). The elongate aperture 56 extends transversely across the bridge and tailpiece body portion 46, and extends generally parallel to the elongate groove 74. The elongate groove 74 is provided with a circular recess aperture 75 disposed near the one end thereof for accommodating a wire of a transducer pickup. Referring again to FIG. 9, it can be seen that the tail portion of the combined bridge and tailpiece body portion 46 is also provided with an elongate aperture 51 disposed therein for providing access to the head of the fastener 96 (e.g., the aperture 51 allows the tip of a screwdriver to engage a recess on the head of the bolt 96).

Figure 10:
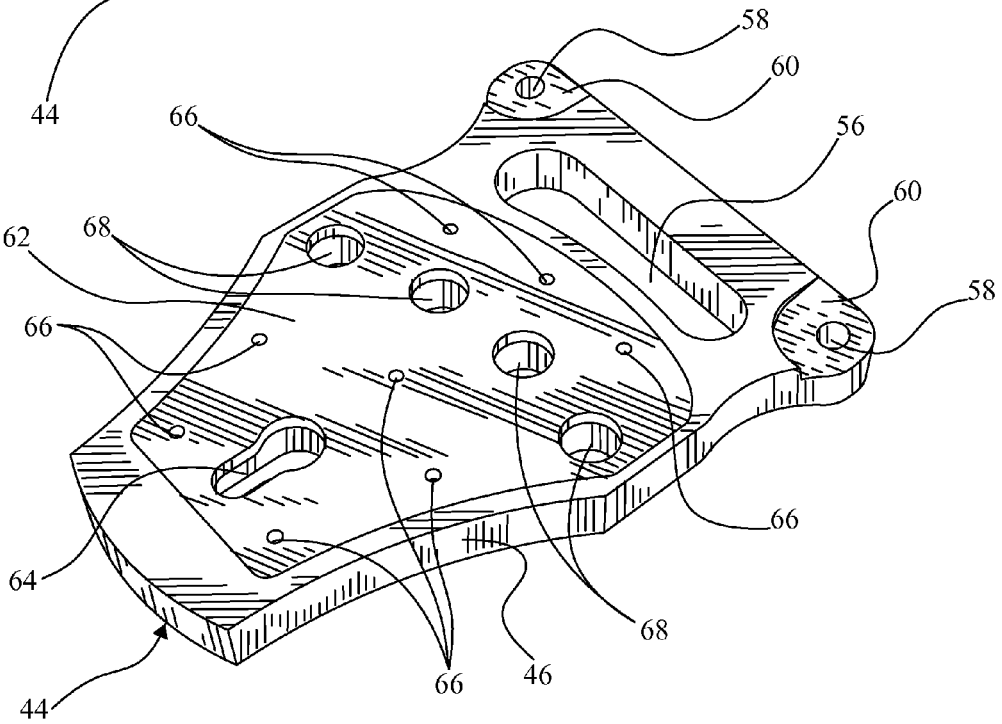
FIG. 10 is a bottom-side perspective view of the bridge and tailpiece combination subassembly of the stringed musical instrument of FIG. 1.
Figure 13:
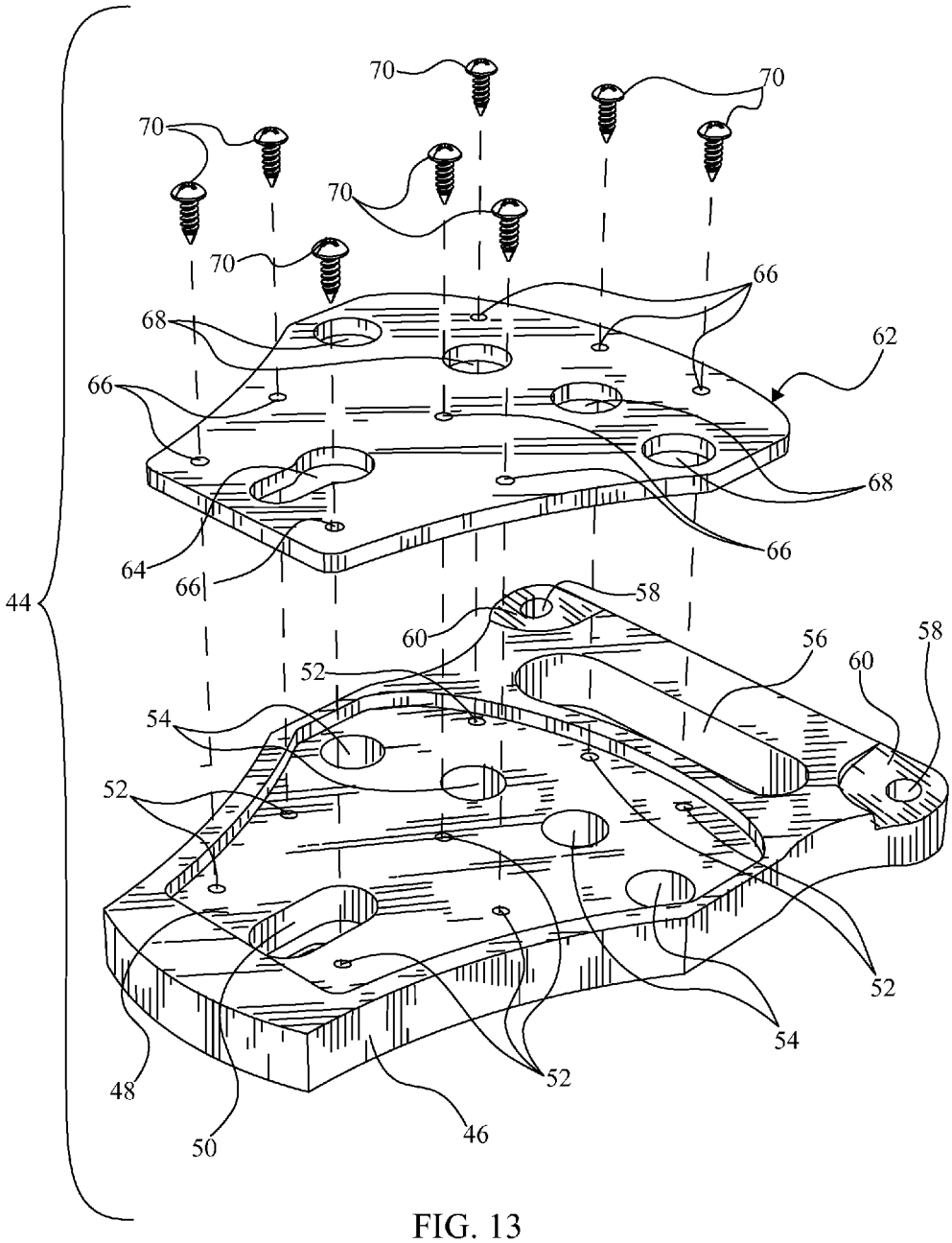
FIG. 13 is an exploded perspective view of the bridge and tailpiece combination subassembly of the stringed musical instrument of FIG. 1.

Next, referring primarily to the exploded view of FIG. 13, the features on the bottom of the combined bridge and tailpiece body portion 46 will be explained. As shown in this figure, the bottom surface of the combined bridge and tailpiece body portion 46 comprises a grounding plate recess 48 disposed therein for accommodating the mounting of the ground plate member 62 in a recessed manner. That is, as best shown in FIG. 10, the depth of the recess 48 in the body portion 46 is generally equal to the thickness of the grounding plate member 62 such that the bottom surface of the grounding plate member 62 lies generally flush to the adjacent, circumscribing bottom surface of the body portion 46. An elongate fastener bore 50 is provided in the tailpiece portion of the grounding plate recess 48 in order to accommodate the head of the bolt 96. Turning again to FIGS. 10 and 13, it can be seen that the bottom corners of the bridge portion of the combined bridge and tailpiece body portion 46 are each provided with fastener recesses 60 formed therein for accommodating the nuts 92 of the respective bolts 88. The circular fastener apertures 58 that receive the shafts of the bolts 88 are generally disposed in the center of the fastener recess areas 60.

Figure 11:
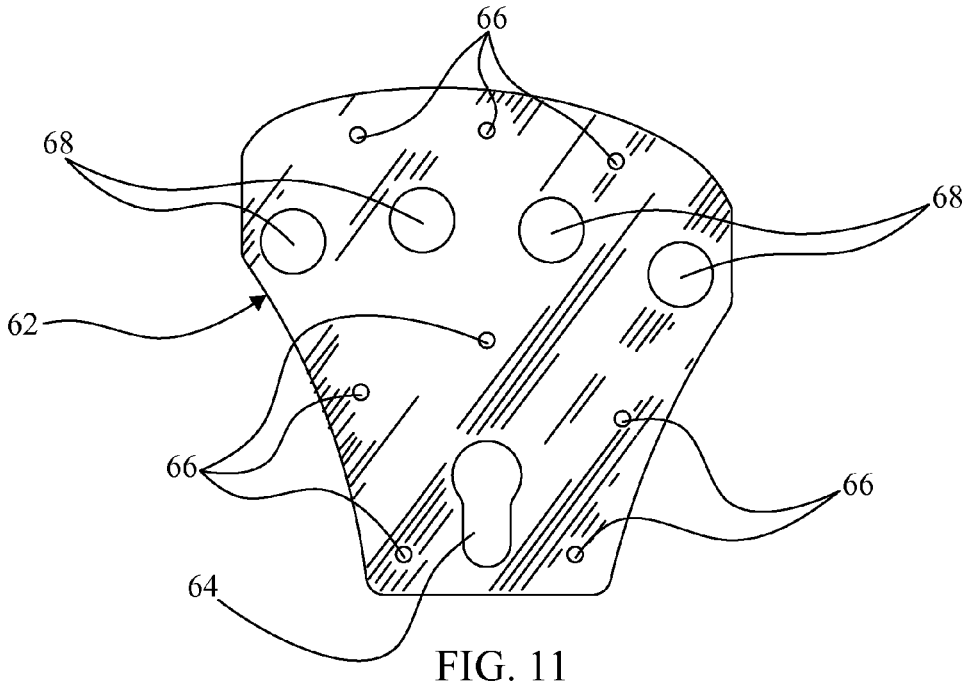
FIG. 11 is a top view of the grounding plate of the bridge and tailpiece combination subassembly of the stringed musical instrument of FIG. 1.
Figure 12:
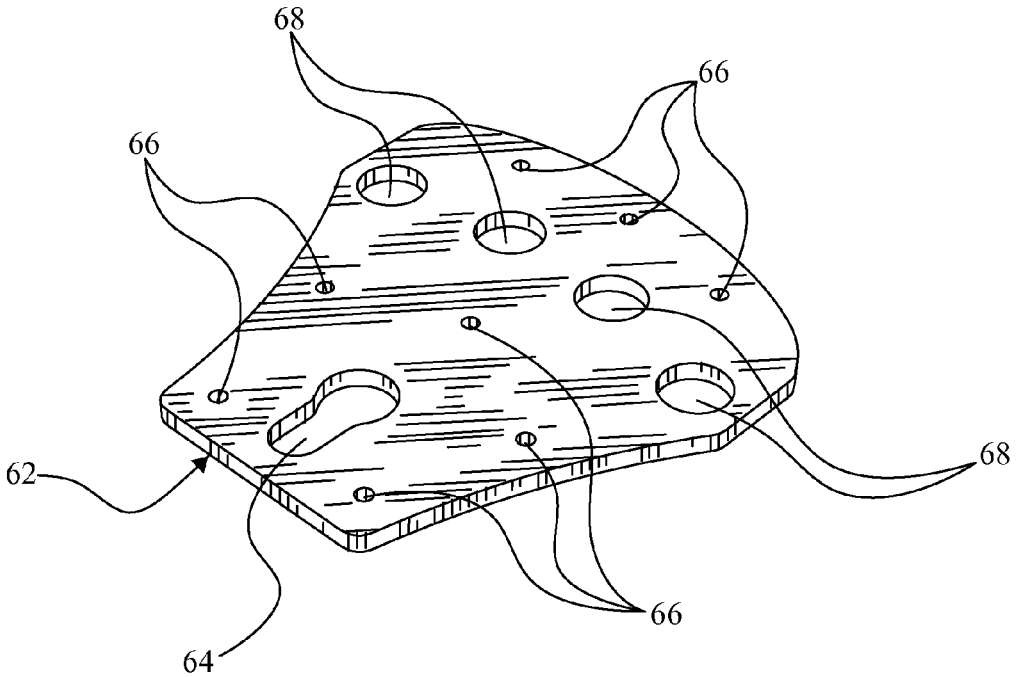
FIG. 12 is a bottom-side perspective view of the grounding plate of the bridge and tailpiece combination subassembly of the stringed musical instrument of FIG. 1.

The features of the illustrative grounding plate member 62 will now be described with reference to FIGS. 11-13. As shown in these figures, the grounding plate member 62 comprises a generally keyhole-shaped aperture 64 that accommodates the bolt 96. In particular, the wider, generally circular portion of the keyhole-shaped aperture 64 allows the head of the bolt 96 to be inserted therein. After the head of the bolt 96 is inserted into the generally circular portion of the keyhole-shaped aperture 64, the shaft of the bolt 96 is then slid into the narrower portion of the keyhole-shaped aperture 64 so that the head of the bolt 96 rests against the top of the grounding plate member 62, thereby retaining the bolt 96 in the keyhole-shaped aperture 64 of the grounding plate member 62. In FIGS. 11-13, it can be seen that the grounding plate member 62 is also provided with a plurality of fastener apertures 66 disposed therein for accommodating the fasteners 70 that secure the grounding plate member 62 to the combined bridge and tailpiece body portion 46. The grounding plate recess 48 in the combined bridge and tailpiece body portion 46 is provided with a plurality of cylindrical recesses 52 that generally correspond to the plurality of fastener apertures 66 in the grounding plate member 62. As such, each fastener 70 passes through its respective fastener aperture 66 in the grounding plate member 62, and then into its respective cylindrical recess 52 in the combined bridge and tailpiece body portion 46. With combined reference to FIGS. 10 and 13, it can be seen that the grounding plate member 62 comprises a plurality of string apertures 68 (i.e., four (4) apertures 68) that generally correspond to the string apertures 54 in the combined bridge and tailpiece body portion 46.

Figure 14:
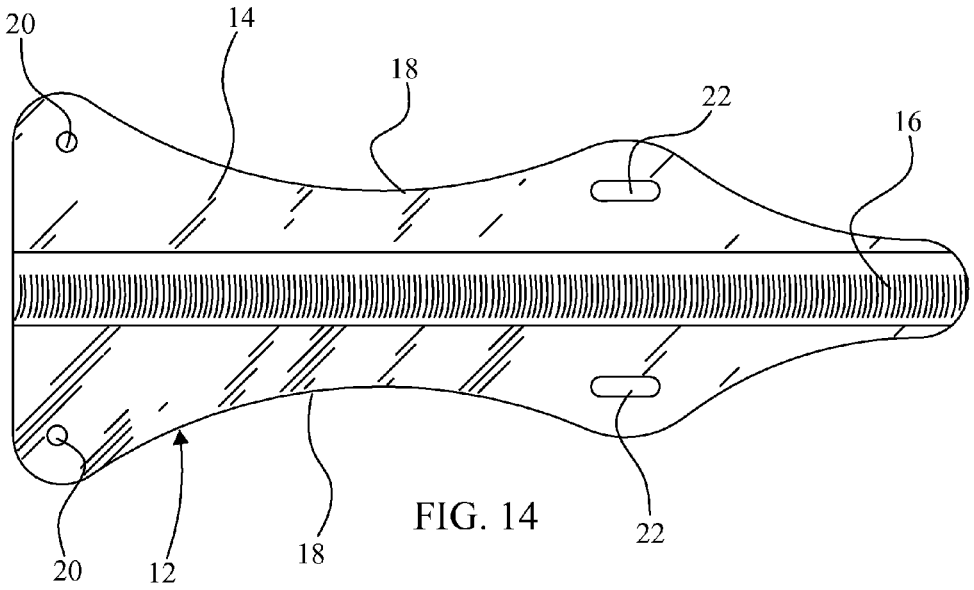
FIG. 14 is a bottom view of the lower displacement component of the stringed musical instrument of FIG. 1.
Figure 15:
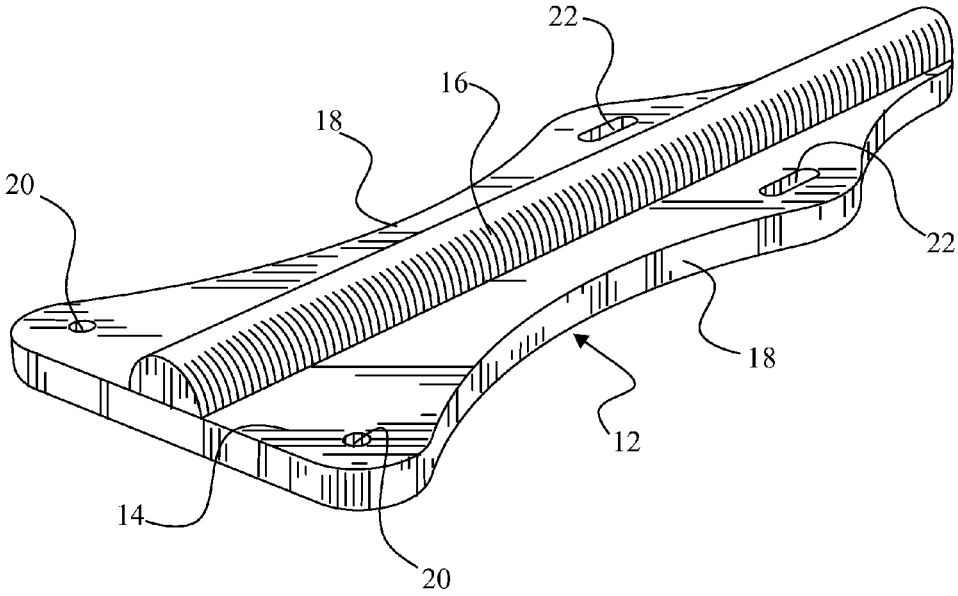
FIG. 15 is a bottom-side perspective view of the lower load displacement component of the stringed musical instrument of FIG. 1.

Now, with reference to FIGS. 3, 6, 14, and 15, the structural features of the lower load displacement component 12 of the load displacement assembly 10 will be described in detail. As explained above, the lower load displacement component 12 transfers the load from the bolts 88 that are connected to the combined bridge and tailpiece body portion 46 to the monopole area of the soundboard 32 (i.e., the soundboard area proximate to the faux bridge 76 and the prime flex point of the instrument). Referring initially to FIGS. 14 and 15, it can be seen that the lower load displacement component 12 generally comprises a planar base portion 14 with a central convex spine portion 16 that enhances a stiffness of the lower load displacement component 12. As best shown in FIG. 15, the central convex spine portion 16 of the lower load displacement component 12 has a semi-cylindrical shape and extends along a length of the base portion 14. Also, it can be seen in FIGS. 14 and 15 that the planar base portion 14 of the lower load displacement component 12 comprises concave notches 18 formed in opposed sides thereof so as to minimize an overall weight of the lower load displacement component 12. Advantageously, the concave notches 18 in the base portion 14 allow the lower load displacement component 12 to be constructed using a length that is sufficient to transfer the load point, without resulting in the addition of excessive weight to the stringed musical instrument 100.

Figure 5:
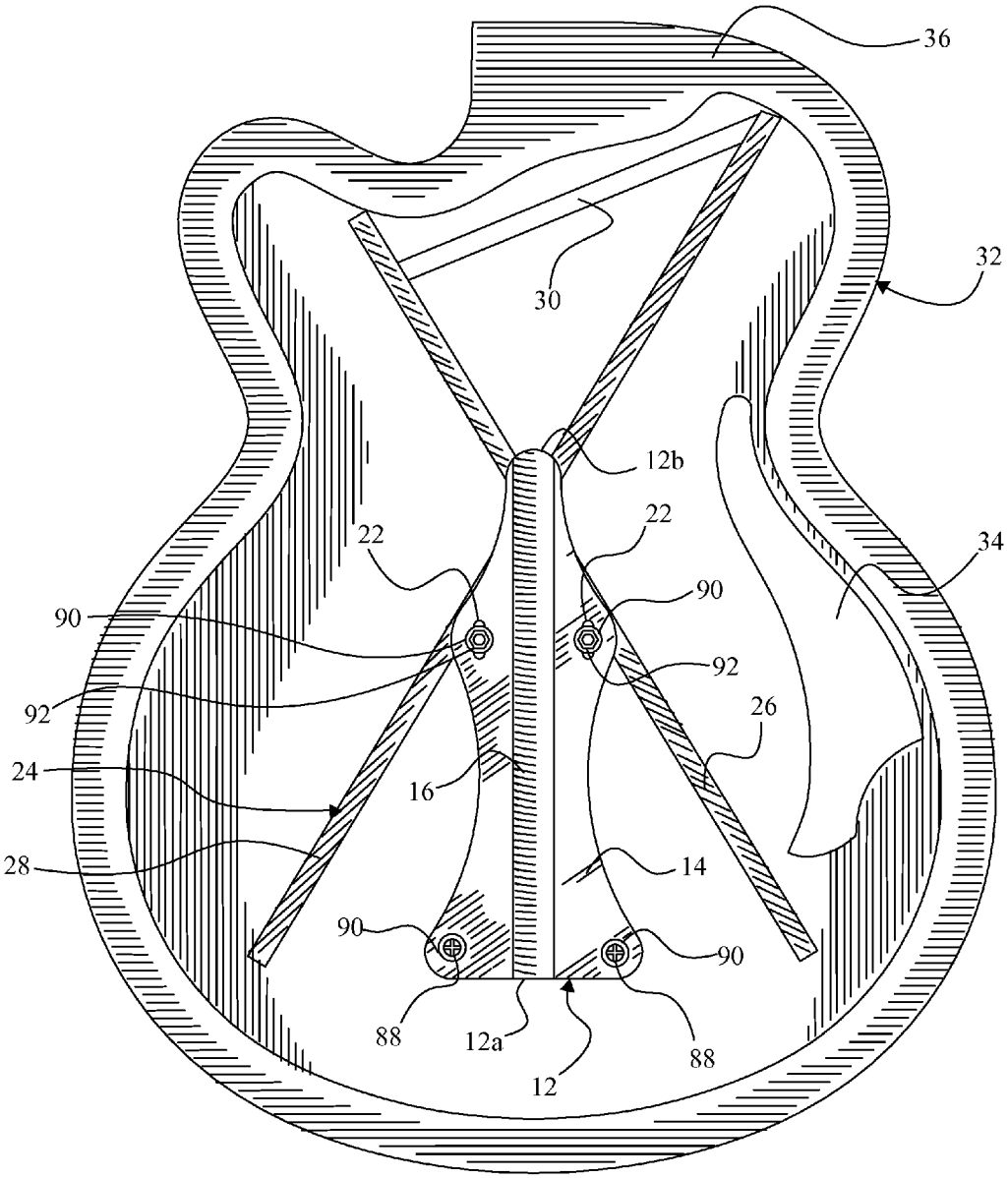
FIG. 5 is a bottom view of the soundboard of the body portion of the stringed musical instrument of FIG. 1, wherein the manner in which the components of the load displacement assembly are attached to the bottom of the soundboard is illustrated.

In addition, as shown in FIGS. 14 and 15, the planar base portion 14 of the lower load displacement component 12 comprises first and second sets of apertures 20, 22 disposed therethrough. Each circular aperture 20 of the first aperture set receives a respective one of bolts 88 that connects the lower load displacement component 12 to the bridge and tailpiece combination subassembly 44. Each elongated aperture 22 of the second aperture set receives a respective one of bolts 88 that connects the lower load displacement component 12 to the faux bridge 76 of the stringed musical instrument 100. As shown in FIGS. 3, 5, and 6, a respective washer 90 and nut 92 is provided on the distal end of each bolt 88 in order to secure the faux bridge 76 and the lower load displacement component 12 to the soundboard 32. Each aperture 22 in the lower load displacement component 12 is elongated, rather than circular like the apertures 20, in order to permit the lower load displacement component 12 to be displaced slightly relative to the bolts 88 that are disposed through the faux bridge 76 (i.e., the elongate apertures 22 permit a slight amount of longitudinal displacement of the lower load displacement component 12 when a load is applied to the load displacement assembly 10). As shown in FIGS. 14 and 15, the first set of apertures 20 is spaced apart from the second set of apertures 22 by a predetermined distance.

Figure 16:
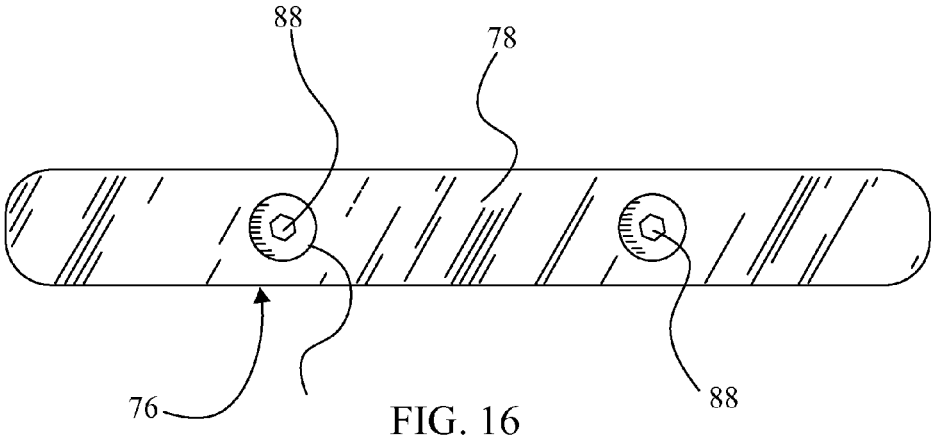
FIG. 16 is a top view of the faux bridge component of the stringed musical instrument of FIG. 1 and its associated fasteners.
Figure 17:
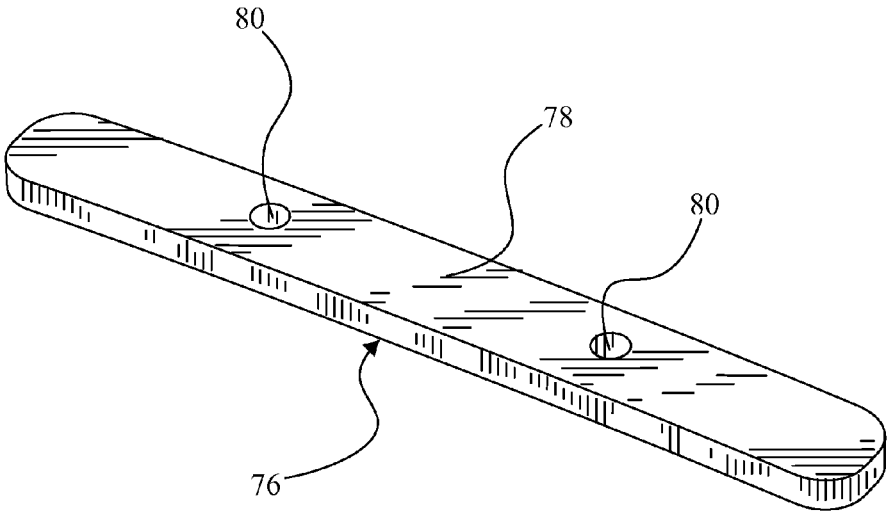
FIG. 17 is a top-side perspective view of the faux bridge component of the stringed musical instrument of FIG. 1.

With reference to FIGS. 3, 6, 16, and 17, the structural features of the faux bridge 76 of the stringed musical instrument 100 will be described in detail. Initially, as shown in FIGS. 16 and 17, it can be seen that the faux bridge 76 comprises an elongate body portion 78 that extends transversely across the soundboard 32 of the stringed musical instrument 100. In an exemplary embodiment, the faux bridge 76 is in the form of a thin strip of wood. Referring again to FIGS. 16 and 17, it can be seen that the body portion 78 of the faux bridge 76 comprises a plurality of spaced-apart apertures 80 (e.g., two (2) apertures 80) disposed therethrough for receiving the shafts of respective bolts 88. The shafts of the bolts 88 pass through respective circular apertures 40 disposed in the soundboard 32 (see FIG. 3). As shown in FIG. 16, each aperture 80 receives a respective bolt 88 for securing the faux bridge 76 to the soundboard 32. Turning to FIGS. 1 and 4, it can be seen that, in its mounted state, the faux bridge 76 is located within the monopole area of the soundboard 32 of the stringed musical instrument 100. That is, the faux bridge 76 is located in the approximate center of the soundboard 32 of the stringed musical instrument 100. Referring to FIGS. 3 and 6, it can be seen that the faux bridge 76 is operatively connected to the lower load displacement component 12 in a load-coupling manner by means of the bolts 88.

Next, with combined reference to FIGS. 3, 5, and 6, the cross-bracing subassembly 24 disposed underneath the soundboard 32 of the stringed musical instrument 100 will be described. As best illustrated in FIGS. 3 and 5, the cross-bracing subassembly 24 is generally in the form of an X-bracing configuration with a first diagonal brace member 26 and a second diagonal brace member 28, which intersects the first diagonal brace member 26. The cross-bracing subassembly 24 also includes a connecting brace member 30 that connects one of the longitudinal ends of the second diagonal brace member 28 to the first diagonal brace member 26, at a location proximate to one of the longitudinal ends of the first diagonal brace member 26. As shown in FIG. 5, the longitudinal end portions of the first and second brace members 26, 28 that are connected by the connecting brace member 30 are disposed at the neck end of the instrument body 104.

As depicted in FIGS. 5 and 6, the brace members 26, 28, 30 of the cross-bracing subassembly 24 are mounted on the bottom surface of the soundboard 32, while the lower load displacement component 12 is mounted on the bottom surfaces of the brace members 26, 28. That is, in its mounted state, the top surface of the lower load displacement component 12 is disposed against the bottom surfaces of the brace members 26, 28 (see FIG. 6). As shown in FIG. 5, the lower load displacement component 12 comprises a first end 12*a* and a second end 12*b*. The second end 12*b* of the lower load displacement component 12 is disposed opposite to the first end 12*a* thereof. The load displacement system connecting members (i.e., bolts 88) are coupled to the lower load displacement component 12 proximate to the first end 12*a* thereof. The second end 12*b* of the lower load displacement component 12 is located proximate to an intersection location of the plurality of brace members 26, 28. As such, when a load is transferred by the lower load displacement component 12, the load is generally transferred from the bolts 88 at the first end 12*a* of the lower load displacement component 12 to the intersection of the cross-bracing members 26, 28 at the second end 12*b* of the lower load displacement component 12. Like the faux bridge 76, the intersection of the cross-bracing members 26, 28 is also disposed in the monopole area of the musical instrument soundboard 32.

Now, to better illustrate the functionality of the invention, the operation of the exemplary load displacement assembly 10 of the stringed musical instrument 100 will be explained with reference to FIGS. 3, 4, and 6. As explained above, the load displacement assembly 10 is advantageously used to transfer from the load point of the instrument 100, which is disposed in a non-musical area (at the saddle member 86), to a musical area (i.e., monopole area) of the soundboard 32 of the instrument 100.

First, when a musician plays the stringed musical instrument 100, he or she applies a vibratory load to one or more of the strings 102. In turn, the one or more strings 102 apply the vibratory load to the saddle member 86. In particular, as diagrammatically illustrated in FIG. 6 by the downwardly directed arrow 124, the one or more strings 102 of the musical instrument 100 generally apply a compressive force or load to the saddle member 86. After which, by virtue of being operatively connected thereto, the saddle member 86 transfers the vibratory load exerted thereon by the one or more strings 102 of the musical instrument 100 to the bridge and tailpiece combination subassembly 44. Specifically, the load results in a moment being applied to the bridge and tailpiece combination subassembly 44, which generally torques the bridge and tailpiece combination subassembly 44 in a clockwise direction about its pivot point near the outer edge of the soundboard 32 (i.e., the bridge and tailpiece combination subassembly 44 generally pivots about pivot point bolt 96 when a load is applied thereto). Then, the vibratory load is transferred from the bridge and tailpiece combination subassembly 44 to each of the connecting members (i.e., bolts 88) of the load displacement assembly 10, which pass through the fastener apertures 58 in the body portion 46 of the bridge and tailpiece combination subassembly 44. The connecting members (i.e., bolts 88), which are received within the circular apertures 20 of the lower load displacement component 12, convey the vibratory load to the first end 12*a* of the lower load displacement component 12. As diagrammatically depicted by the curved arrow 128 in FIG. 6, the lower load displacement component 12 generally transfers the vibratory load from its first end 12*a* to its second end 12*b*. As such, the vibratory load that is originally applied to the saddle member 86 by the strings 102 is transferred from a non-musical area on the soundboard 32 of the instrument body 104 to a musical area (i.e., monopole area) of the soundboard 32 that comprises the faux bridge 76 and the intersection of the diagonal brace members 26, 28 underneath the soundboard 32. Referring again to FIG. 6, as diagrammatically represented by the arrows 124 and 126, the vibratory load conveyed by the lower load displacement component 12 is transferred to the faux bridge 76, and thus, to the monopole area of the soundboard 32. The vibratory load conveyed by the lower load displacement component 12 tends to pull down on the faux bridge 76. In addition, with reference again to FIG. 6, the vibratory load conveyed by the lower load displacement component 12 is also transferred to the intersection of the diagonal brace members 26, 28 which, like the faux bridge 76, is also located in the monopole area of the soundboard 32 of the musical instrument 100. Therefore, the vibratory load that initially is applied to the non-musical area of the instrument 100 is advantageously transferred from this non-musical area to a musical area of the instrument 100 by the inventive load displacement assembly 10.

It is readily apparent that the aforedescribed load displacement assembly 10 and the stringed musical instrument 100 including the same offer numerous advantages. First, the load displacement assembly 10 is capable of displacing a musical instrument's desired load point so as to match up with alternative, desired scale lengths, while maintaining the proper bearing point location for correct intonation. Secondly, the load displacement assembly 10 enables different scale lengths and instrument formats to be readily combined with one another without comprising the proper load bearing tone of the instrument 100. Finally, the load displacement assembly 10 described herein can be easily adapted for use with virtually all stringed musical instrument formats.

While the load displacement assembly 10 has been described in conjunction with the stringed musical instrument 100 above, which is generally in the form of an acoustic bass, it is to be understood that the load displacement assembly 10 can be utilized with virtual any type of stringed musical instrument. For example, in addition to flat top acoustic instruments, such as steel string guitars, nylon string guitars, bass guitars, ukuleles, sitars, dulcimers, autoharps, harp guitars and banjos, the load displacement assembly 10 may also be used with arch top instruments, such as violins, violas, cellos, basses, guitars, mandolins, and mandolas. In addition to the above listed instruments the uses for the stringed musical instrument 100 would include multi-string, multi-scale, baritone, harp guitars, extended scale, multi-neck, single string extensions, acoustic, electric, acoustic/electric, semi-hollow body instruments or any combination of the above. Regardless of the type of stringed musical instrument on which the load displacement assembly 10 is utilized, the functional benefits are the same. Namely, the load displacement assembly 10 displaces the load point from the prime intonation point on the acoustic instrument to accommodate longer or shorter scale lengths. For example, the load displacement assembly 10 can be used to accommodate scale lengths ranging from approximately twenty-five (25) inches to approximately forty-four (44) inches. As described above, the load displacement assembly 10 utilizes a quasi-cantilevered design that can be permanently bolted (or glued) onto the instrument's resonating chamber so as to accommodate the new or alternative scale length. The mechanism's length may vary depending on the desired scale length and the boundaries of the existing instrument's format.

Although the invention has been shown and described with respect to a certain embodiment or embodiments, it is apparent that this invention can be embodied in many different forms and that many other modifications and variations are possible without departing from the spirit and scope of this invention.

For example, in one or more alternative embodiments, one or more components of the load displacement assembly 10 may be glued to the soundboard 32 of the stringed musical instrument 100 using a suitable adhesive, rather than using fasteners.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A load displacement assembly comprising, in combination:

a saddle member, said saddle member configured to receive a load from one or more strings of a musical instrument;

at least one upper load displacement component, said at least one upper load displacement component configured to be disposed above a soundboard of a musical instrument, said at least one upper load displacement component being coupled to said saddle member in a load carrying manner, and said at least one upper load displacement component configured to transfer said load from said saddle member to one or more connecting members, said one or more connecting members configured to pass through said soundboard of said musical instrument; and a lower load displacement component, said lower load displacement component configured to be disposed beneath said soundboard of said musical instrument, said lower load displacement component being coupled to said one or more connecting members in a load carrying manner, said lower load displacement component configured to transfer said load from said one or more connecting members to a monopole area of said soundboard of said musical instrument, said lower load displacement component comprising a body portion, said body portion of said lower load displacement component including concave notches formed in opposed sides thereof so as to minimize an overall weight of said lower load displacement component, said lower load displacement component further comprising a plurality of apertures disposed through said body portion thereof, a first set of said plurality of apertures being configured to receive said one or more connecting members, a second set of said plurality of apertures being configured to receive fasteners for coupling said lower load displacement component to a faux bridge of said musical instrument, said second set of said plurality of apertures being spaced apart from said first set of said plurality of apertures by a predetermined distance.

2. The load displacement assembly according to claim 1, wherein said at least one upper load displacement component comprises a combined bridge and tailpiece subassembly, said combined bridge and tailpiece subassembly configured to be mounted in a suspended position above said soundboard of said musical instrument.

3. The load displacement assembly according to claim 2, wherein said combined bridge and tailpiece subassembly includes a bridge and tailpiece body portion and a plate member, said plate member being removably coupled to said bridge and tailpiece body portion.

4. The load displacement assembly according to claim 1, wherein said one or more connecting members comprise one or more threaded fastening devices configured to pass through said soundboard of said musical instrument.

5. The load displacement assembly according to claim 1, wherein said lower load displacement component further comprises a central convex spine portion configured to enhance a stiffness of said lower load displacement component.

6. A stringed musical instrument comprising, in combination:

a musical instrument body with a soundboard, said musical instrument body including one or more brace members disposed underneath said soundboard;

a neck having a first end portion and a second end portion, said second end portion of said neck being coupled to said musical instrument body;

a plurality of strings extending from said first end portion of said neck to said soundboard of said musical instrument body;

a load displacement assembly coupled to said soundboard of said musical instrument body, said load displacement assembly including a load bearing component, each of said plurality of strings configured to apply a load to said load bearing component, said load displacement assembly configured to transfer said load applied to said load bearing component by each of said plurality of strings to a monopole area of said soundboard of said musical instrument, said load displacement assembly further comprising:

at least one upper load displacement component, said at least one upper load displacement component disposed above said soundboard of said musical instrument body, said at least one upper load displacement component being coupled to said load bearing component in a load carrying manner, and said at least one upper load displacement component configured to transfer said load from said load bearing component to one or more connecting members, said one or more connecting members configured to pass through said soundboard of said musical instrument body; and a lower load displacement component having a top surface, said lower load displacement component being disposed beneath said one or more brace members of said musical instrument body, said lower load displacement component being spaced apart from said soundboard by said one or more brace members, said top surface of said lower load displacement component being disposed against a bottom surface of said one or more brace members, said lower load displacement component being coupled to said one or more connecting members in a load carrying manner, said lower load displacement component configured to transfer said load from said one or more connecting members to a portion of said one or more brace members in said monopole area of said soundboard of said musical instrument; wherein said lower load displacement component comprises a body portion and a plurality of apertures disposed through said body portion thereof, a first set of said plurality of apertures receiving said one or more connecting members, a second set of said plurality of apertures receiving fasteners for coupling said lower load displacement component to a faux bridge of said musical instrument, said second set of said plurality of apertures being spaced apart from said first set of said plurality of apertures by a predetermined distance.

7. The stringed musical instrument according to claim 6, wherein said at least one upper load displacement component comprises a combined bridge and tailpiece subassembly, said combined bridge and tailpiece subassembly configured to be mounted in a suspended position above said soundboard of said musical instrument.

8. The stringed musical instrument according to claim 7, wherein said combined bridge and tailpiece subassembly includes a bridge and tailpiece body portion and a plate member, said plate member being removably coupled to said bridge and tailpiece body portion.

9. The stringed musical instrument according to claim 6, wherein said one or more connecting members comprise one or more threaded fastening devices configured to pass through said soundboard of said musical instrument.

10. The stringed musical instrument according to claim 6, wherein said lower load displacement component comprises a central convex spine portion configured to enhance a stiffness of said lower load displacement component.

11. The stringed musical instrument according to claim 6, wherein said body portion of said lower load displacement component including concave notches formed in opposed sides thereof so as to minimize an overall weight of said lower load displacement component.

12. The stringed musical instrument according to claim 6, wherein said faux bridge is located within said monopole area of said soundboard of said musical instrument.

13. The stringed musical instrument according to claim 6, wherein said one or more brace members comprise a plurality of brace members disposed underneath said soundboard; and wherein said lower load displacement component comprises a first end and a second end, said second end of said lower load displacement component being disposed opposite to said first end, said one or more connecting members being coupled to said lower load displacement component proximate to said first end thereof, and said second end of said lower load displacement component being located proximate to an intersection location of said plurality of brace members.

14. The stringed musical instrument according to claim 6, wherein said load bearing component, is located outside of said monopole area of said soundboard of said musical instrument.

15. A stringed musical instrument comprising, in combination:

a musical instrument body with a soundboard, said musical instrument body having a head end and a tail end;

a neck having a first end portion and a second end portion, said second end portion of said neck being coupled to said head end of said musical instrument body;

a plurality of strings extending from said first end portion of said neck to said soundboard of said musical instrument body;

a load displacement assembly coupled to said soundboard of said musical instrument body, said load displacement assembly including a load bearing component and a plurality of load displacement components coupled to one another in load carrying succession, a first of said plurality of load displacement components in said load carrying succession being disposed above said soundboard and proximate to said tail end of said musical instrument body, a second of said plurality of load displacement components in said load carrying succession passing through said soundboard of said musical instrument, and a last of said plurality of load displacement components in said load carrying succession being disposed beneath said soundboard of said musical instrument and closer to a central soundboard area of said musical instrument body than said first of said plurality of load displacement components, each of said plurality of strings configured to apply a load to said load bearing component, said load bearing component configured to transfer said applied load to said first of said plurality of load displacement components in said load carrying succession, said second of said plurality of load displacement components in said load carrying succession configured to transfer said applied load from said first of said plurality of load displacement components to said last of said plurality of load displacement components, and said last of said plurality of load displacement components in said load carrying succession configured to transfer said load to a monopole area of said soundboard of said musical instrument; wherein said last of said plurality of load displacement components comprises a body portion with a plurality of apertures disposed through said body portion, a first one of said plurality of apertures receiving said second of said plurality of load displacement components therein, and a second one of said plurality of apertures receiving a fastener for coupling said last of said plurality of load displacement components to a faux bridge of said musical instrument, said second one of said plurality of apertures being spaced apart from said first one of said plurality of apertures by a predetermined distance.

16. The stringed musical instrument according to claim 15, wherein said first of said plurality of load displacement components comprises a combined bridge and tailpiece subassembly, said combined bridge and tailpiece subassembly configured to be mounted in a suspended position above said soundboard of said musical instrument, said combined bridge and tailpiece subassembly having a first end and a second end disposed opposite to said first end, said load bearing component being disposed proximate to said first end of said combined bridge and tailpiece subassembly, and said second end of said combined bridge and tailpiece subassembly being disposed proximate to a curved sidewall at said tail end of said musical instrument body.

17. The stringed musical instrument according to claim 16, wherein said combined bridge and tailpiece subassembly includes a bridge and tailpiece body portion and a plate member, said plate member being removably coupled to an underside of said bridge and tailpiece body portion.

18. The stringed musical instrument according to claim 17, wherein said combined bridge and tailpiece subassembly comprises a plurality of apertures disposed through said bridge and tailpiece body portion, a first of said plurality of apertures receiving said second of said plurality of load displacement components therein, and a second of said plurality of apertures receiving a fastener for attaching said combined bridge and tailpiece subassembly to said soundboard of said musical instrument.

* * * * *